US006526613B1

(12) United States Patent
Penley

(10) Patent No.: US 6,526,613 B1
(45) Date of Patent: Mar. 4, 2003

(54) GOLF SHAFT EVALUATOR

(75) Inventor: Carter Penley, San Diego, CA (US)

(73) Assignee: Penley Sports, LLC, San Diego, CA (US)

( * ) Notice: Subject to any disclaimer, the term of this patent is extended or adjusted under 35 U.S.C. 154(b) by 0 days.

(21) Appl. No.: 10/002,493

(22) Filed: Oct. 23, 2001

(51) Int. Cl.[7] ..... B01D 7/00
(52) U.S. Cl. ..... 7/65.03
(58) Field of Search ..... 73/849, 852, 855, 73/856, 65.01, 65.03

(56) References Cited

U.S. PATENT DOCUMENTS

| | | | | |
|---|---|---|---|---|
| 2,250,428 A | | 7/1941 | Vickery | |
| 4,097,626 A | | 6/1978 | Tennent | |
| 4,555,112 A | | 11/1985 | Masghati | |
| 4,563,007 A | | 1/1986 | Bayliss et al. | |
| 4,757,997 A | | 7/1988 | Roy | |
| 5,106,087 A | | 4/1992 | Simmons et al. | |
| 5,192,073 A | | 3/1993 | Iwanaga et al. | |
| 5,496,028 A | | 3/1996 | Chien | |
| 5,538,769 A | | 7/1996 | Sandman, Jr. | |
| 5,599,242 A | | 2/1997 | Solviche et al. | |
| 5,685,783 A | | 11/1997 | Akatsuka et al. | |
| 5,776,008 A | | 7/1998 | Lundberg | |
| 5,814,773 A | * | 9/1998 | Latiri | 177/171 |
| 5,865,688 A | | 2/1999 | Bae | |
| 5,924,936 A | | 7/1999 | Penley | |
| 5,943,758 A | | 8/1999 | Haas | |
| 5,964,670 A | | 10/1999 | Cheng | |
| 5,976,028 A | * | 11/1999 | Ciccarello et al. | 473/289 |
| 6,302,805 B1 | | 10/2001 | Penley | |

* cited by examiner

*Primary Examiner*—Max Noori
(74) *Attorney, Agent, or Firm*—Nydegger & Associates

(57) ABSTRACT

An apparatus for locating the spine of a golf club shaft and performing dynamic stiffness measurements on the golf club shaft includes a clamp assembly and a flexing assembly. Both assemblies are mounted on a common frame and distanced from each other to allow the clamp assembly to operate on one end of the golf club shaft and the flexing assembly to operate on the other end. The clamp assembly includes two collets having six pins per collet to clamp the shaft. A mechanism to rotate the clamped shaft about its axis is provided. The flexing assembly includes a robotic hand to deflect and release the free end of the shaft. A force gage is provided to measure. the force required to deflect the shaft. A photo eye is included in the flexing assembly to measure the oscillation frequency of a shaft that has been deflected and released.

22 Claims, 3 Drawing Sheets

GOLF SHAFT EVALUATOR

FIELD OF THE INVENTION

The present invention pertains generally to a device for evaluating the stiffness of a golf shaft. More particularly, the present invention pertains to a device which uses stiffness measurements to locate the spine of a golf club shaft. The present invention is particularly, but not exclusively, useful as a device for finding the spine of a golf club shaft under static conditions and then determining the dynamic stiffness of the shaft at various angles about the shaft's axis from the spine.

BACKGROUND OF THE INVENTION

A typical golf club includes a head, a shaft and a grip. The head is attached to one end of the shaft and includes a face for contact with a golf ball. An elastomeric grip covers the other end of the shaft. Typically, the shaft is elongated and substantially cylindrical. Generally, the shaft is slightly tapered from a larger cross-section at the grip end to a smaller cross-section where the head is attached.

During the golf swing, the shaft is exposed to various forces. For example, because the face of the club head is not located on the axis of the shaft, the shaft is exposed to a torsional force when the club head impacts the ball. Moreover, a lateral or bending force is imparted to the shaft both at ball impact and during portions of the golf swing when the club head is accelerated or decelerated.

The actual amount of bend and twist experienced by the shaft during the golf swing will depend on the dimensions and construction of the shaft. Specifically, the flexibility (i.e. stiffness) of the shaft will determine the amount of bend and twist experienced by the shaft during the swing and at impact with the ball. As it happens, different golfers prefer shafts having different stiffnesses. For example, tour players that have an extremely fast swing speed generally prefer stiff shafts that will bend and twist very little during the swing. Because the amount of bend and twist is reduced, the head of the club is maintained at a proper alignment relative to the shaft resulting in a "square" club face at impact. On the other hand, some players, such as women and seniors, often prefer flexible shafts. These players generally have a slower swing speed, and rely on a whipping action created by the flexible shaft to increase club head speed at ball impact. In any case, all golfers generally seek a set of clubs having little or no variation in shaft flexibility from club to club within the set.

Modern shafts are made of metal such as steel or composite materials such as carbon fiber (graphite) embedded in an epoxy matrix. During manufacture of both metal and composite shafts, a spine (sometimes called a seam) is generally created in the shaft. For example, to create a steel shaft, a flat shaft blank is typically rolled onto a tapered cylindrical mandrel and the edges of the blank are butt welded together. The weld creates a spine in the shaft that extends along the length of the shaft. Similarly, in shafts made from composite materials, fibers are generally woven into either a cloth-like material or a uni-directional tape and then impregnated with resin. In one technique, several pieces of impregnated cloth-like material or uni-directional tape are successively wrapped around a tapered cylindrical mandrel and then cured to form a composite shaft. Unfortunately, even when a substantial effort is expended to line up the ends of the successive pieces of cloth, overlaps and mismatches between the ends of adjacent pieces create a spine in the composite shaft.

Of important interest for the present invention, the spine affects the stiffness of the shaft. Specifically, the spine causes the stiffness of the shaft to vary when measured at different shaft angles. Stated another way, a different force is required to bend the shaft when the spine and axis of the shaft are in the plane of the bend than when the spine of the shaft is not in the bend plane. Importantly, this variation in stiffness can be used to locate the position of the spine of a shaft when the location of the spine is not visible. For purposes of the present disclosure, a spine plane can be defined as the plane containing both the axis of the shaft and the spine of the shaft. To locate the spine in this manner, the shaft is generally positioned horizontally with one end of the shaft clamped between two flat or "v"-shaped jaws. Then, a standard weight is attached to the second end of the shaft and the deflection of the second end is measured. Next, as the shaft is slowly rotated about the longitudinal axis of the shaft, a variation in the deflection of the second end becomes apparent. Since the spine is generally the stiffest part of the shaft, the spine location can be found by rotating the shaft until the deflection of the second end is at a minimum. Unfortunately, thin and fragile shafts are often damaged when clamped between two flat or "v" shaped jaws.

For purposes of the present disclosure, the technique for locating a spine described above is considered a static analysis since the second end of the shaft is essentially motionless when the deflection is measured. Once the position of the spine is located and marked, this information can be used in club building. Specifically, each club head can be oriented on the shaft with the spine positioned at a predetermined orientation relative to the club head face to thereby create a set of clubs having a consistent spine orientation and feel from club to club.

It is to be appreciated that when a player swings a golf club, the shaft does not always experience a simple static bend. In addition to the presence of a spine discussed above, other factors such as the orientation of fibers in a composite shaft or defects present in a metal or composite shaft can cause the stiffness of the shaft to vary with shaft angle. Unfortunately, static bend tests often fail to detect these defects. To more adequately model the dynamic golf swing and detect certain shaft defects, dynamic stiffness measurements can be used as a quality control tool to discard shafts having non-optimal dynamic stiffness.

After the spine has been located using the above described static analysis, dynamic stiffness measurements can be performed. To determine the dynamic stiffness of a shaft on various bend planes running through the shaft axis, one end of the shaft must be held. Next, the second end of the shaft is deflected and released to cause the second end of the shaft to oscillate within the original spine plane. The oscillation frequency is then measured as an indication of dynamic stiffness. The procedure can be repeated at different shaft angles. For example, the second end of the shaft can be deflected and released to oscillate in a plane normal to the original spine plane, and the oscillation frequency recorded. Once the dynamic stiffness at various shaft angles has been measured, the results can be used to discard shafts having dynamic stiffness values outside a predetermined range.

In light of the above it is an object of the present invention to provide a device suitable for the purposes of accurately determining the location of a golf club shaft spine and the dynamic stiffness of the shaft at various shaft angles relative to the spine. It is another object of the present invention to provide a device capable of performing both static and dynamic stiffness measurements on a golf club shaft without removing, realigning and regripping the shaft between tests.

It is yet another object of the present invention to provide a device for measuring the stiffness of a golf club shaft having an improved clamping mechanism that firmly holds one end of the shaft during testing but does not damage thin and fragile shafts. Yet another object of the present invention is to provide a golf club evaluator which is easy to use, relatively simple to manufacture, and comparatively cost effective.

SUMMARY OF THE PREFERRED EMBODIMENTS

The present invention is directed to an apparatus for evaluating a golf club shaft. Specifically, the apparatus measures the static stiffness of the golf club shaft at radial increments to first locate the spine of the golf club shaft. Once the spine of the golf club shaft is located, the apparatus can determine the dynamic stiffness of the shaft at several radial orientations. For the present invention, the apparatus includes a clamp assembly and a flexing assembly. The assemblies are mounted on a common frame and distanced from each other to allow the clamp assembly to operate on one end of the golf club shaft and the flexing assembly to operate on the other end of the golf club shaft. The function of the clamp assembly is to hold one end of the golf club shaft and rotate the golf club shaft about the axis of the golf club shaft. The function of the flexing assembly is to deflect the head end of the golf club shaft and perform stiffness measurements.

In accordance with the present invention, the clamp assembly includes a tube, a first collet and a second collet. Preferably, the two collets are identical in construction and spaced apart along the length of the tube. The tube has a wall and is formed as an elongated, hollow cylinder that defines a tube axis along the longitudinal axis of the cylinder. For purposes of the present disclosure, the tube axis extends from the tube and through the flexing assembly. The wall of the tube is formed with an outer surface and an inner surface that surrounds the inside of the tube. Each collet has a set of six pins. To accommodate the pins of the first collet, six holes are formed in the wall of the tube. Preferably, the six holes are equally spaced around the circumference of the tube and located on a common plane. The common plane is preferably oriented normal to the tube axis.

Each pin is disposed in one of the holes formed in the tube, and extends into the tube radially through the wall of the tube. As such, each pin has a first end disposed within the tube for contact with the golf club shaft and a second end disposed outside of the tube. The first collet further includes a moveable collar positioned around the outside of the tube, and mounted on the tube. A recessed chamber is formed in the moveable collar facing the outer surface of the tube and extending around the circumference of the tube. The recessed chamber is formed with a conical surface that is distanced from the outer surface of the tube. The conical surface is beveled between a first end positioned relatively close to the outer surface of the tube and a second end positioned relatively far from the outer surface of the tube.

For the present invention, the second end of each pin extends into the recessed chamber and contacts the conical surface. Springs are provided to bias each pin away from the tube axis to thereby ensure the second end of each pin remains in contact with the conical surface at all times. This structure allows the moveable collar to be translated axially along the outside of the tube from a first position wherein a golf club shaft located within the tube is unclamped (released) to a second position wherein the golf club shaft within the tube is clamped. In the first position, the second end of each pin is in contact with the second end of the conical surface (the end farthest away from the outer surface of the tube).

During axial translation of the moveable collar along the outside of the tube from the first position to the second position, each pin is forced to translate radially into the tube, thereby creating a clamping force on a golf club shaft positioned in the tube. When the moveable collar is in the second position, the second end of each pin is in contact with the conical surface near the first end of the conical surface. To release the golf club shaft, the moveable collar can be axially translated along the outer surface of the tube from the second position to the first position. For the present invention, a motor driven lead screw can be used to translate the moveable collar axially along the outer surface of the tube. The second collet, which is constructed in the same manner as the first collet, is distanced from the first collet along the length of the tube to thereby allow the end of the golf club shaft to be clamped at two places (i.e. by two sets of pins).

A DC motor is provided for rotating the tube and collets about the tube axis. A belt or chain running around the tube can be driven by the DC motor to rotate the clamp assembly about the tube axis. Preferably, the DC motor is controlled by an electronic processor, such as a programmable logic controller (PLC). A desired rotation angle, $\theta$, can be input into the PLC by the operator. The PLC can then cause the motor to rotate the tube and collets through the desired rotation angle, $\theta$.

As indicated above, the function of the flexing assembly is to deflect the head end of the golf club shaft and perform stiffness measurements. The flexing assembly includes a robotic grab and release hand having two fingers. Each finger has a first end, second end and a midsection between the first end and the second end. Rollers for contacting the golf club shaft are attached to each finger at the finger's first end.

The midsection of each finger is pivotally mounted to a plate, while the second end of each finger is attached to the shaft of a pneumatic cylinder. For the present invention, the pneumatic cylinder can be used to reconfigure the hand between a grab configuration and a release configuration. The rollers are juxtaposed in the grab configuration to allow the rollers to contact and hold the shaft during deflexion of the shaft. In the release configuration, the rollers are spaced apart to release the golf club shaft.

For the present invention, the robotic hand, plate and pneumatic cylinder are slideably mounted to a linear track. A pneumatic linear actuator is provided to move the hand, plate and cylinder along the linear track. With this cooperation of structure, the robotic hand, plate and cylinder move along a linear axis that is oriented at an angle of approximately 80 to 90 degrees from the tube axis. Thus, a bend plane containing both the linear axis and the tube axis is defined. Specifically, the hand, plate and cylinder are moveable along the linear axis to position the hand for grabbing the golf club shaft, and for subsequently deflecting the golf club shaft. The flexing assembly further includes a force gage such as a load cell to measure the force required to move the hand and thereby deflect the end of the golf club shaft through a predetermined distance.

For the present invention, a processor such as a PLC can be connected to a photo eye to measure the oscillation frequency of the end of the golf club shaft after the golf club shaft is deflected and released. Specifically, the photo eye can be positioned to pass a beam of light in a direction normal to the bend plane. More specifically, the light source can be positioned to pass the beam of light through the bend plane near the tube axis and into a reflector. Breaks in the reflected light beam can be used to calculate the oscillation frequency of the golf club shaft.

Adjustable limit sensors are provided to determine whether the oscillating golf club shaft travels outside of the vertical bend plane by a predetermined amount. Specifically, a photo eye can be positioned at the predetermined distance from the original bend plane and oriented to pass a beam of light in a direction parallel to the original bend plane. For the present invention, the distance between the light beam and the original bend plane can be adjusted by moving the photo eye. A reflector directs the light beam back to the photo eye. If the golf club shaft oscillates outside the bend plane by a predetermined amount, a break in the light beam will be detected by the photo eye for recordation by the processor. If desired, two adjustable limit sensors can be utilized, one on each side of the bend plane.

To use the apparatus to evaluate a golf club shaft, both the clamp assembly and the flexing assembly are first set up to receive the golf club shaft. Specifically, for the clamp assembly, the moveable collar is translated axially to the first position wherein the springs cause each pin to move away from the tube axis. Additionally, for the flexing assembly, the hand is configured into the release configuration wherein the rollers are separated. Next, the golf club shaft is inserted into the apparatus and clamped. In detail, one end of the golf club shaft is inserted into and through the tube until the other end of the golf club shaft is positioned in the tube. Then, one or both of the moveable collars are translated axially into their second positions wherein each pin is forced toward the tube axis to thereby clamp one end of the golf club shaft.

Once the golf club shaft is inserted into the apparatus and one end is clamped, the spine of the golf club shaft can be located. For this purpose, the robotic hand is first translated along the linear axis using the linear actuator until the midsection of each finger is positioned adjacent to the free end of the golf club shaft. Next, the hand is reconfigured into the grab configuration wherein the rollers are juxtaposed. Once the hand is in the grab configuration, the hand can be translated along the linear axis using the linear actuator until the rollers contact the head end of the golf club shaft. Upon contact between the rollers and the golf club shaft, the hand can be further translated along the linear axis to deflect the end of the golf club shaft to a holding point located at a predetermined distance from the tube axis. The force sensor indicates the force required to deflect the end of the golf club shaft to the holding point.

Next, while the end of the golf club shaft is deflected, the golf club shaft can be indexed through a full 360 degrees of rotation. Specifically, the collets and golf club shaft are incrementally rotated about the tube axis using the DC motor described above. The rollers on the fingers of the robotic hand allow the deflected end of the golf club shaft to rotate freely. After each increment of rotation, the force sensor measures the force required to maintain the end of the golf club shaft deflected to the holding point. As indicated above, measurements from the force sensor can be used to determine the location of the spine. Once the spine is located, the processor can be used to rotate the golf club shaft until the spine is oriented in the bend plane. For the present invention, the rotation of the golf club shaft to orient the spine in the bend plane can be performed while the shaft is deflected.

Once the spine is located and oriented in the bend plane, dynamic stiffness measurements can be performed. Specifically, the free end of the golf club shaft can be grabbed and deflected using the process described above. More specifically, the end of the golf club shaft can be deflected to a release point. Once the shaft is deflected, the hand can be reconfigured into the first configuration wherein the rollers are separated using the pneumatic cylinder to release the deflected end of the golf club shaft. Upon release, the end of the golf club shaft is free to oscillate about the tube axis. During oscillation, the oscillation frequency is measured using the photo eye and processor as described above. Additionally, the adjustable limit sensors can determine whether the golf club shaft oscillates outside of the bend plane by more than a predetermined amount. After dynamic stiffness measurements have been taken with the spine in the bend plane, the collets and golf club shaft can be rotated through a predetermined angle (such as 90 degrees) to a new orientation. After rotation to the new orientation, the golf club shaft can be deflected and released to thereby allow the oscillation frequency to be measured at the new orientation. This process can be repeated to allow the oscillation frequency to be measured at several angular orientations around the golf club shaft.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
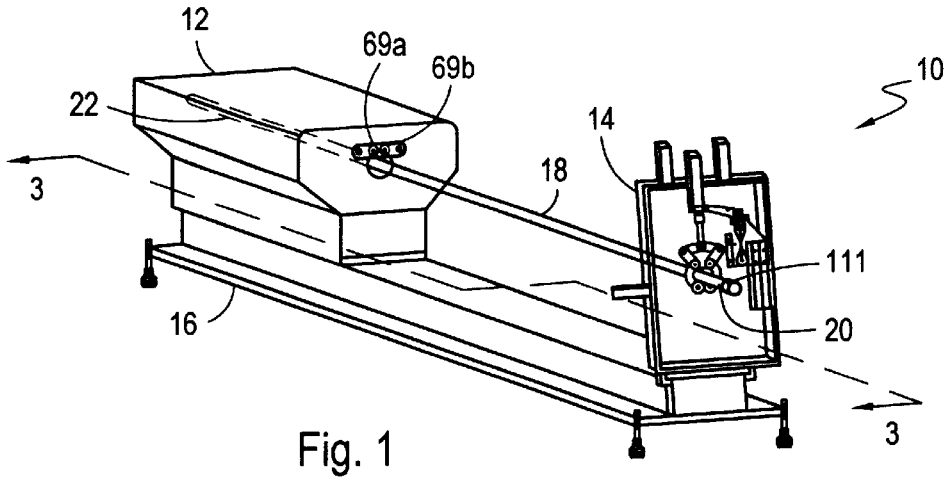
FIG. 1 is a perspective view of a golf club shaft evaluator in accordance with the present invention.

Referring initially to FIG. 1, an apparatus in accordance with the present invention for determining the location of a spine in a golf club shaft and performing dynamic stiffness measurements is shown and generally designated 10. As shown, the apparatus 10 includes a clamp assembly 12 and a flexing assembly 14. For the present invention, both the clamp assembly 12 and the flexing assembly 14 are mounted on a common frame 16. FIG. 1 further shows a shaft 18 for a golf club positioned in the apparatus 10 with the head end 20 of the shaft 18 passing through the flexing assembly 14 and the grip end 22 (shown in phantom) of the shaft 18 inserted into the clamp assembly 12. For the present invention, either the head end 20 or the grip end 22 can be clamped, and the grip end 22 can be clamped with or without a grip installed.

Figure 2:
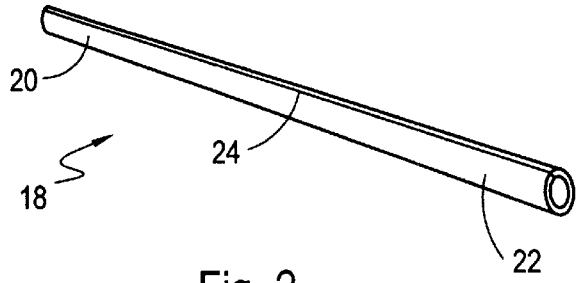
FIG. 2 is a perspective view of a golf club shaft having a spine.

Referring now to FIG. 2, an exemplary shaft 18 for a golf club is shown. For the present invention, the shaft 18 can be metal, a composite material such as S-glass or carbon fiber in an epoxy matrix, or any other material known in the pertinent art suitable for use as a golf club shaft. As shown, the shaft 18 may contain a spine 24 extending along the shaft 18 from the grip end 22 of the shaft 18 to the head end 20 of the shaft 18. Generally, the spine 24 is caused by the manufacturing process used to create the shaft 18, and affects the stiffness and other properties of the shaft 18.

Figure 3:
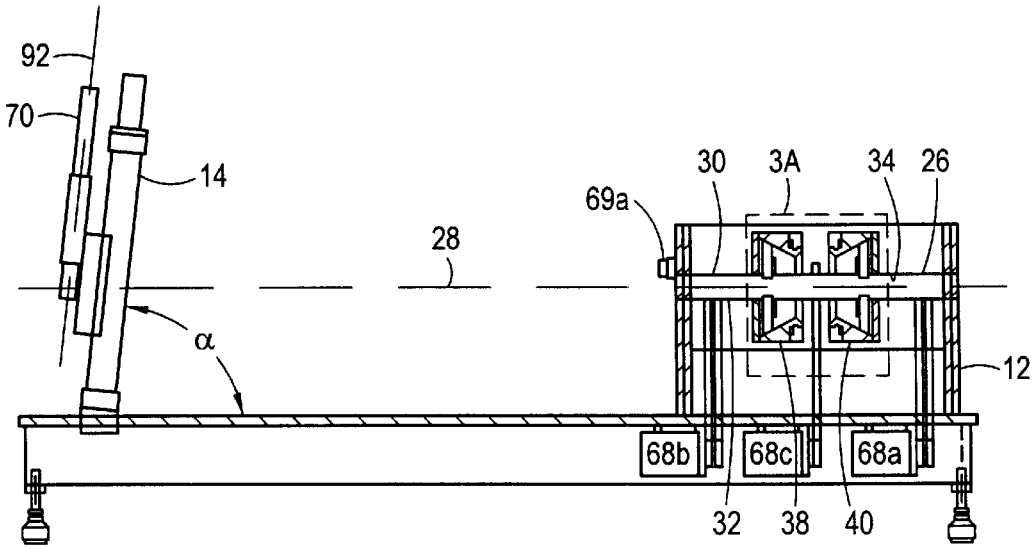
FIG. 3 is a partial cross sectional view of the golf club shaft evaluator as seen along line 3—3 in FIG. 1.

Referring now to FIG. 3, the clamp assembly 12 includes a tube 26 that defines a tube axis 28. As shown, the tube 26 has a wall 30 and is formed as an elongated, hollow cylinder. The wall 30 of the tube 26 is formed with an outer surface 32 and an inner surface 34. FIG. 3 further shows that the clamp assembly 12 includes two collets 38, 40 that are mounted on the tube 26 and axially spaced apart along the tube 26. With cross reference to FIGS. 3A and 4, it can be seen that collet 40 has a set of six pins 42*a–f*. Similarly, it is to be appreciated that collet 38 has six pins 44.

Figure 3A:
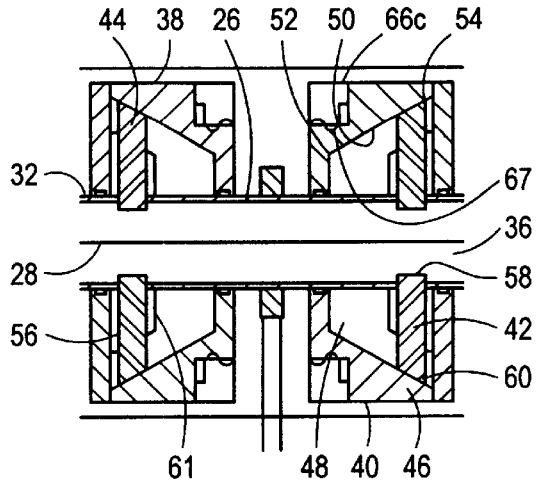
FIG. 3A is an enlarged cross sectional view of a portion of the clamp assembly as enclosed by line 3A—3A in FIG. 3.

FIG. 3A further shows that the collet 40 includes a moveable collar 46 mounted on the outer surface 32 of the tube 26. As shown, a recessed chamber 48 is formed in the moveable collar 46 facing the outer surface 32 of the tube 26 and extending around the circumference of the tube 26. Further, the recessed chamber 48 is formed with a conical surface 50 that is distanced from the outer surface 32 of the tube 26. For the present invention, the conical surface 50 has a first end 52 that is spaced relatively close to the outer surface 32 of the tube 26 and a second end 54 that is spaced relatively far from the outer surface 32 of the tube 26.

Figure 3B:
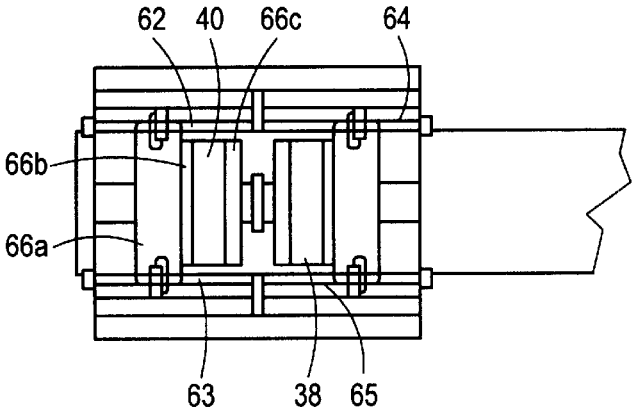
FIG. 3B is a top view of the clamp assembly with the cover removed for clarity.
Figure 4:
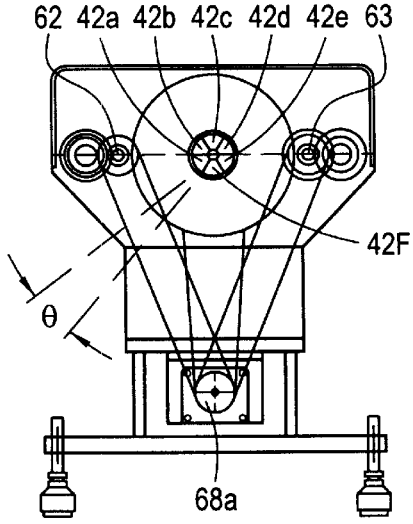
FIG. 4 is a rear view of the clamp assembly with the cover removed for clarity, showing the drive motor, pulleys and lead screws for activating one of the collets.

The cooperation of structure between the tube 26, pins 42 and moveable collar 46 can be best appreciated with combined reference to FIGS. 3A, 3B and 4. To allow the pins 42 to pass through the wall 30 of the tube 26, holes 56 (one for each pin 42) are formed in the wall 30. Preferably, the six holes 56 are equally spaced around the circumference of the tube 26 and located on a common plane. The common plane is preferably oriented normal to the tube axis 28, as shown. Also shown, each pin 42 is disposed in one of the holes 56 and extends radially through the wall 30 and into the tube 26. As such, each pin 42 has a first end 58 disposed within the tube 26 for contact with the golf club shaft and a second end 60 that extends into the recessed chamber 48 of the moveable collar 46 and contacts the conical surface 50. Holders 61 mounted on the tube 26 are provided to maintain the position of the pins 42, 44. Springs (not shown) are positioned in the holders 61 to bias each pin 42 away from the tube axis 28 to thereby ensure the second end 60 of each pin 42 remains in contact with the conical surface 50. With this structure, the moveable collar 46 can be translated along the tube 26 to drive the pins 42 towards the tube axis 28 (for clamping) and the moveable collar 46 can be translated in the reverse direction to retract the pins 42 from the inside of the tube 26. As shown, lead screws 62, 63, 64 and 65 are provided to translate the moveable collar 46 axially along the outer surface 32 of the tube 26. Also shown, brackets 66*a–c* attach the collet 40 to the lead screws 62, 63, and a bearing 67 is provided to allow the collet 40 to rotate relative to the bracket 66*c*. Motors 68*a, b* (shown in FIG. 3) are provided to drive the lead screws 62, 63, 64, 65.

Referring back to FIG. 3, a motor 68*c* is provided for rotating the tube 26, pins 42, 44 and moveable collars 46 of the collets 38, 40 about the tube axis 28. Preferably, motor 68*c* is a stepper motor controlled by an electronic processor such as a programmable logic controller, or PLC (not shown). A desired rotation angle, θ, (shown in FIG. 4) can be input into the PLC. The PLC can then cause the motor 68*c* to rotate the tube 26, pins 42, 44 and moveable collar 46 of the collets 38, 40 and shaft 18 through the desired rotation angle, θ. Optional rollers 69*a–b*, shown in FIG. 1, can be provided for contacting the deflected shaft 18 between the clamp assembly 12 and the flexing assembly 14.

In the preferred embodiment of the present invention, the motor 68*c* and PLC are configured to allow the torque response of a shaft 18 to be measured. Specifically, to measure torque response, one end of the shaft 18 is held in one or both of the collets 38, 40. A manual clamp (not shown) can be provided to hold the other end of the shaft 18. Next, the PLC is programmed to cause the motor 68*c* to rotate the shaft 18, tube 26, pins 42, 44 and moveable collars 46 of the collets 38, 40 about the tube axis 28 until a constant torque of approximately one foot-pound is applied to the shaft 18. Upon the application of this torque, the resultant rotational deflection of the shaft 18 which is generally in the range of approximately 0.2 to 5 degrees can be measured. In particular, the PLC can calculate the rotational deflection of the shaft 18 based on the rotational movement of the motor 68*c* that has occurred during application of the torque. For the case where motor 68*c* is a stepper motor, the motor 68*c* can be rotated in steps until the desired torque is applied to the shaft 18. Next, the number of steps required to impart the desired torque can be used by the PLC to calculate the rotational deflection of the shaft 18.

Figure 5:
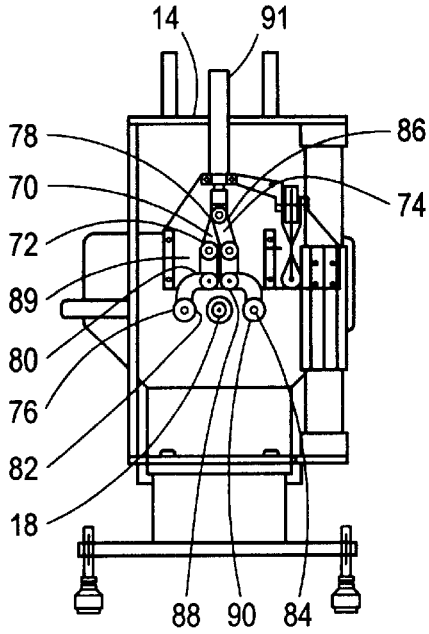
FIG. 5 is a front elevation view of the golf club shaft evaluator showing the fingers of the robotic hand in the release configuration.

Referring now to FIG. 5, it can be seen that the flexing assembly 14 includes a robotic grab and release hand 70 having two opposed fingers 72, 74. As shown, the finger 72 has a first end 76, a second end 78 and a midsection 80 located between the first end 76 and the second end 78. Further, a roller 82 is attached to the first end 76 of the finger 72. Similarly, the finger 74 has a first end 84, a second end 86 and a midsection 88 located between the first end 84 and the second end 86. Each midsection 80, 88 is pivotally mounted on a plate 89 which moves with the hand 70. Further, a roller 90 is attached to the first end 84 of the finger 74. For the present invention, each roller 82, 90 is free to rotate independently of the fingers 72, 74.

Figure 6:
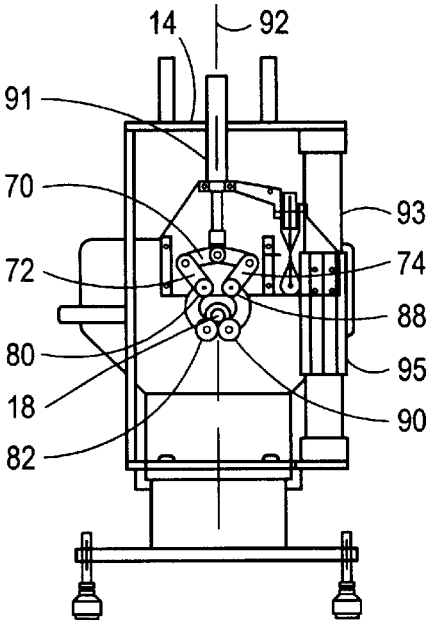
FIG. 6 is a front elevation view of the golf club shaft evaluator showing the fingers of the robotic hand in the grab configuration.

The hand 70 can be reconfigured by activation of a pneumatic cylinder 91 between a grab configuration (shown in FIG. 6) and a release configuration (shown in FIG. 5). As shown in FIG. 6, in the grab configuration, the distance between the rollers 82, 90 is less than the diameter of the shaft 18. Conversely, in the release configuration, the distance between the rollers 82, 90 is larger than the diameter of the shaft 18, as shown in FIG. 6.

Figure 7:
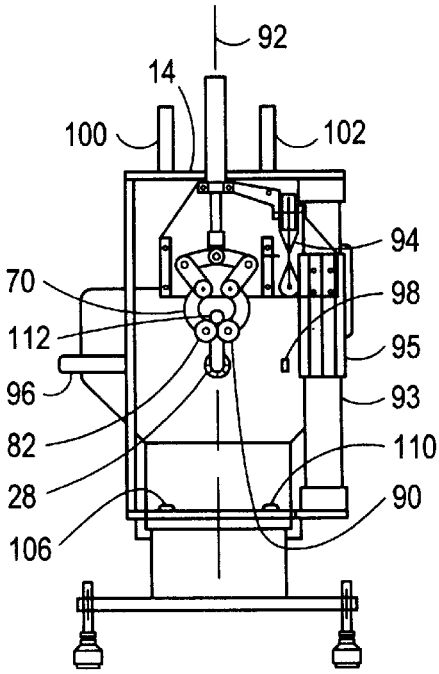
FIG. 7 is a front elevation view of the golf club shaft evaluator showing the one end of the golf club shaft being deflected by the flexing assembly.

Referring now to FIG. 3, it can be seen that the flexing assembly 14 is preferably oriented at an angle, α, of approximately 80 to 90 degrees to the tube axis 28. By cross referencing FIGS. 3, 5 and 7, it can be seen that the hand 70, plate 89 and cylinder 91 are slideably mounted on a linear track 93 for movement along a linear axis 92 that is oriented at the angle, α, to the tube axis 28. A pneumatic linear actuator 95 is provided to move the hand 70, plate 89 and cylinder 91 along the track 93. FIG. 7 shows the flexing assembly 14 after the hand 70 has been moved along the linear axis 92 to deflect the shaft 18. Thus, by cross referencing FIGS. 3 and 7, it can be seen that the shaft 18 deflects in a bend plane that contains the linear axis 92 and the tube axis 28.

Referring now to FIG. 7, for the present invention, the flexing assembly 14 further includes a force gage 94, such as a MLP-10 load cell manufactured by Transducer Techniques, that is connected to the hand 70 to measure the force required to deflect the head end 20 of the shaft 18 through a predetermined distance. Further, as shown, the flexing assembly 14 includes a photo eye 96, such as a Banner Mini beam SME 312 LP photo eye, positioned to pass a beam of light in a direction normal to the bend plane. The beam is directed into a reflector 98, such as reflective tape, positioned on the opposite side of the bend plane. The photo eye 96 is provided to measure the oscillation frequency of the shaft 18 after the shaft 18 has been deflected and released. The electrical output of the photo eye 96 can be sent to a processor (not shown) where the interval between breaks in the light beam can be used to calculate the oscillation frequency of the shaft 18.

Also shown in FIG. 7, the flexing assembly 14 includes photo eyes 100 and 102 connected to the processor (not shown) for the purpose of determining if the oscillating shaft 18 travels outside of the bend plane by a predetermined distance. Specifically, the photo eye 100 is moveably attached to the plate 89 at the predetermined distance from the original bend plane. The photo eye 100 is oriented to emit a beam of light in a direction parallel to the original bend plane to a reflector 106. The reflected beam is then received by the photo eye 100. The distance between the original bend plane and the photo eye 100 can be varied by moving the photo eye 100 with respect to the plate 89. Similarly, the photo eye 102 is moveable. The photo eye 102 can be positioned on the opposite side of the bend plane from the photo eye 100 and at the predetermined distance from the original bend plane. Further, as shown, the photo eye 102 is oriented to pass a beam of light in a direction parallel to the original bend plane to a reflector 110. The electrical output of each photo eye 100, 102 can be sent to a processor (not shown), where breaks in the light beam (indicating that the golf club shaft has oscillated outside the bend plane by a predetermined amount) can be recorded or displayed.

Referring to FIG. 1, to evaluate a shaft 18, first the apparatus 10 is setup to receive and clamp the shaft 18. Specifically, the clamp assembly 12 is configured with the pins 42, 44 positioned away from the tube axis 28 as shown in FIG. 3A. To accomplish this, the moveable collar 46 of each collet 38, 40 is translated along the tube 26 until the pins 42, 44 are positioned in contact with the second end 54 of the conical surface 50. Additionally, the flexing assembly 14 is configured with the hand 70 in the release configuration as shown in FIG. 5, wherein the rollers 82, 90 are separated. Next, as shown in FIG. 1, the shaft 18 is inserted into the apparatus 10 with the grip end 22 positioned in the clamp assembly 12 and the head end 20 positioned in the flexing assembly 14.

Once inserted into the apparatus 10, the shaft 18 can be clamped between the pins 42, 44 of the collets 38, 40. With combined reference to FIGS. 3A and 4, it can be seen that the moveable collar 46 of each collet 38, 40 can be translated along the tube 26 until the pins 42, 44 can be positioned in contact with the conical surface 50 near the first end 52 of the conical surface 50. By translating the moveable collar 46 of each collet 38, 40 in this manner, the pins 42, 44 can be forced towards the tube axis 28 and thus a clamping force is thereby applied to the shaft 18. FIG. 4 shows the pins 42 of collet 40 in the clamped configuration.

Once the shaft 18 is clamped in the apparatus 10, the spine 24 (shown in FIG. 2) of the shaft 18 can be located and marked as follows. First, referring to FIG. 5, the hand 70 can be translated along the linear axis 92 until the rollers 82, 90 are adjacent to the shaft 18, by pressurizing the cylinder 91. Next, the hand 70 can be reconfigured from the release configuration (shown in FIG. 5) to the grab configuration (shown in FIG. 6) wherein the rollers 82, 90 are juxtaposed. Once the hand 70 is in the grab configuration, the hand 70, plate 89 and cylinder 91 can be translated along the linear axis 92 to deflect the shaft 18 to a holding point (such as point 112) located at a predetermined distance from the tube axis 28, as shown in FIG. 7. Once deflected to the holding point, the force gage 94 can measure the force required to deflect the shaft 18.

Next, referring to FIGS. 3, 4 and 7, it is to be appreciated that while the golf club shaft is deflected, the pins 42, 44, moveable collars 46 of the collets 38, 40, the tube 26 and the shaft 18 can be rotated through an angle, θ, (angle, θ, shown in FIG. 4) about the tube axis 28 using the motor 68*c*. Referring now to FIG. 7, the rollers 82, 90 allow the shaft 18 to rotate freely at the flexing assembly 14. After rotation of the shaft 18 through the angle, θ, the force gage 94 can once again measure the force required to deflect the shaft 18. This process can be repeated (i.e. the process of rotating the shaft 18 through the angle, θ, and measuring the deflection force) until the shaft 18 has been rotated a total of 360 degrees. It is contemplated for the present invention that an angle, θ, of approximately 0.45 degrees can be used. Thus, approximately 800 force measurements can be taken during one complete rotation of the shaft 18. As indicated above, measurements from the force gage 94 can be used to locate the spine 24 of the shaft 18. Once the spine 24 is located, the processor (not shown) can cause the shaft 18 to be rotated until the spine 24 is oriented in the bend plane (i.e. the plane containing the tube axis 28 and the linear axis 92). For the present invention, the rotation of the shaft 18 to orient the spine 24 in the bend plane can be performed while the shaft 18 is deflected, or after the shaft 18 is released.

Once the spine 24 is located and oriented in the bend plane as described above, dynamic stiffness measurements can be performed. For the dynamic stiffness measurements, a weight 111 can be mounted on the second end 20 of the shaft 18 as shown in FIG. 1. This weight 111 is provided to simulate a golf club head and is preferably about 205 grams. If desired, one of the collets 38, 40 can be released prior to the dynamic stiffness measurement. Next, the flexing assembly 14 can be used to grab and deflect the shaft 18 using the process described above. Specifically, the shaft 18 can be deflected to a release point such as point 112 shown in FIG. 7. Next, the hand 70 can be reconfigured into the release configuration (shown in FIG. 5) wherein the rollers 82, 90 are separated by a distance greater than the diameter of the shaft 18. Once released, the head end 20 of the shaft 18 is free to oscillate about the tube axis 28. During oscillation, the photo eye 96 and processor described above can be used to measure the oscillation frequency. Further, the photo eyes 100, 102 and processor can be used to determine whether the oscillation occurs outside of the bend plane by a predetermined amount. After the oscillation frequency is measured, the shaft 18 can be rotated through a predetermined angle (such as 90 degrees) about the shaft axis 28. After rotation through the predetermined angle, the shaft 18 can again be deflected and released to thereby allow the oscillation frequency to be measured for the shaft 18 at the new orientation. This process can be repeated to allow the oscillation frequency to be measured at various angular orientations around the shaft 18.

While the particular Golf Shaft Evaluator as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An apparatus for measuring the stiffness of a golf club shaft, the shaft having a first end and a second end, said apparatus comprising:

a collet for clamping the first end of the shaft, said collet defining a collet axis and having a plurality of pins, said pins lying substantially in a common plane oriented normal to said collet axis with each said pin being for radial movement with respect to said collet axis;

a means for reconfiguring said collet between a release configuration wherein each said pin is distanced from said axis by a first distance and a clamped configuration wherein each said pin is distanced from said axis by a second distance, said second distance being smaller than said first distance;

a means for rotating each said pin about said collet axis while said collet is in said clamped configuration to allow the stiffness of the shaft to be measured at a plurality of predetermined angular orientations;

a means for deflecting the second end of the shaft away from the collet axis to a holding point located at a predetermined distance from said collet axis; and a means for measuring the load required to deflect the second end of the shaft to said holding point.

2. An apparatus as recited in claim 1 wherein said means for reconfiguring said collet comprises a motor.

3. An apparatus as recited in claim 1 wherein said collet is a first collet and said common plane is a first common plane, and further comprising:

a second collet having a plurality of pins, said pins of said second collet lying substantially in a second common plane oriented substantially perpendicular to said collet axis, said second plane distanced from said first plane with each said pin of said second collet for radial movement with respect to said collet axis.

4. An apparatus as recited in claim 3 wherein said first collet has six pins and said second collet has six pins.

5. An apparatus as recited in claim 1 wherein said means for measuring the load required to deflect the second end of the shaft to said holding point is a force gage.

6. An apparatus as recited in claim 1 further comprising:

a means for deflecting the second end of the shaft to a release point located a predetermined distance from said collet axis and releasing the second end of the shaft to thereby cause the second end of the shaft to oscillate about said collet axis; and a means for measuring the oscillation frequency of the second end of the shaft.

7. An apparatus as recited in claim 6 wherein said means for measuring the oscillation frequency of the second end of the shaft comprises a photo eye.

8. An apparatus as recited in claim 6 further comprising a means for determining whether the shaft oscillates beyond a predetermined distance from a plane containing said collet axis and said release point.

9. An apparatus as recited in claim 8 wherein said determining means comprises a photo eye.

10. An apparatus as recited in claim 1 wherein said deflecting means comprises a robotic grab and release hand.

11. An apparatus as recited in claim 1 wherein said reconfiguring means comprises a motor.

12. An apparatus for measuring the stiffness of a golf club shaft, the shaft having a first end and a second end, said apparatus comprising:

a collet for clamping the first end of the shaft, said collet defining a collet axis and having a plurality of pins, said pins lying substantially in a common plane oriented normal to said collet axis with each said pin being for radial movement with respect to said collet axis;

a motorized means for reconfiguring said collet between a release configuration wherein each said pin is distanced from said axis by a first distance and a clamped configuration wherein each said pin is distanced from said axis by a second distance, said second distance being smaller than said first distance;

a means for deflecting the second end of the shaft to a predetermined release point located at a distance from said collet axis and releasing the second end of the shaft to cause the second end of the shaft to oscillate about said collet axis; and a means for measuring the oscillation frequency of the second end of the shaft.

13. An apparatus as recited in claim 12 further comprising a motorized means for rotating said pins about said collet axis while said collet is in said clamped configuration to allow for successive oscillation frequency measurements at different angular orientations while the shaft remains clamped.

14. An apparatus as recited in claim 12 further comprising a means for determining whether the shaft oscillates beyond a predetermined distance from a plane containing said collet axis and said release point.

15. A method for evaluating a golf club shaft, said shaft defining a longitudinal axis and having a first end and a second end, said method comprising the steps of:

positioning said first end of said shaft between a plurality of pins, said pins lying substantially in a common plane, said longitudinal axis of said shaft extending substantially normal to said common plane;

activating a motor to move each said pin radial towards said longitudinal axis of said shaft to clamp said shaft between said pins;

applying a deflection force to said second end of said shaft to move said second end of said shaft through a predetermined distance to a holding point; and measuring said force.

16. A method as recited in claim 15 further comprising the steps of:

rotating said pins and said shaft through an angle, $\theta$, about said longitudinal axis of said shaft; and measuring the holding force required to hold said second end of said shaft at said holding point.

17. A method as recited in claim 16 wherein said angle, $\theta$, is approximately equal to 0.45 degrees, and said rotating step and said measurement step are repeated approximately 800 times.

18. A method as recited in claim 17 wherein said shaft is formed with a spine and further comprising the steps of:

using the data from said measurement steps to determine the location of the spine of the golf club shaft;

marking the location of the spine on the shaft; and releasing said holding force.

19. A method as recited in claim 18 further comprising the steps of:

attaching a weight to said second end of said shaft;

deflecting said second end of said shaft to a predetermined release point;

releasing said second end of said shaft from said release point to cause said second end of said shaft to oscillate; and measuring the oscillation frequency of said second end of said shaft.

20. A method as recited in claim 19 wherein said weight is approximately two hundred and five grams (205 gms).

21. A method as recited in claim 19 wherein said shaft defines a spine plane containing said spine and said longitudinal axis of said shaft, and wherein said shaft is oriented in said pins with said spine plane containing said release point.

22. A method as recited in claim 21 further comprising the steps of:

rotating said pins and said shaft through an angle of approximately 90 degrees about said longitudinal axis of said shaft;

deflecting said second end of said shaft to said release point;

releasing said second end of said shaft from said release point to cause said second end of said shaft to oscillate; and measuring the oscillation frequency of said second end of said shaft.

* * * * *